US010655449B2

(12) United States Patent
Garner et al.

(10) Patent No.: US 10,655,449 B2
(45) **Date of Patent: *May 19, 2020**

(54) REAL-TIME TENSION, COMPRESSION AND TORQUE DATA MONITORING SYSTEM

(71) Applicant: BAKER HUGHES, A GE COMPANY, LLC, Houston, TX (US)

(72) Inventors: Louis D. Garner, Calgary (CA); Lubos Vacik, Calgary (CA); Silviu Livescu, Calgary (CA)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/438,413

(22) Filed: Feb. 21, 2017

(65) Prior Publication Data

US 2017/0248004 A1 Aug. 31, 2017

Related U.S. Application Data

(60) Provisional application No. 62/300,280, filed on Feb. 26, 2016.

(51) Int. Cl.

| | |
|---|---|
| ***E21B 47/00*** | (2012.01) |
| ***E21B 44/00*** | (2006.01) |
| ***E21B 47/06*** | (2012.01) |
| ***E21B 47/12*** | (2012.01) |

(52) U.S. Cl.

CPC ..... *E21B 47/0006* (2013.01); *E21B 44/00* (2013.01); *E21B 47/06* (2013.01); *E21B 47/065* (2013.01); *E21B 47/12* (2013.01)

(58) Field of Classification Search

CPC .... E21B 47/0006; E21B 47/06; E21B 47/065; E21B 47/12

USPC ..... 73/152.49, 152.01–152.62

See application file for complete search history.

(56) References Cited

U.S. PATENT DOCUMENTS

| | | | | |
|---|---|---|---|---|
| 4,267,727 | A * | 5/1981 | Hoppe | E21B 47/0006 73/152.59 |
| 4,811,597 | A * | 3/1989 | Hebel | E21B 47/0006 73/152.48 |
| 4,875,530 | A | 10/1989 | Frink et al. | |
| 8,387,720 | B1 * | 3/2013 | Keast | E21B 44/00 175/24 |
| 8,733,438 | B2 * | 5/2014 | Kenison | E21B 44/00 166/250.01 |
| 9,512,708 | B2 * | 12/2016 | Hay | E21B 41/0092 |
| 2001/0045300 | A1 * | 11/2001 | Fincher | E21B 7/068 175/26 |
| 2005/0103123 | A1 | 5/2005 | Newman | |
| 2007/0112521 | A1 * | 5/2007 | Akimov | G01V 11/00 702/6 |
| 2008/0060846 | A1 * | 3/2008 | Belcher | E21B 17/042 175/25 |

(Continued)

FOREIGN PATENT DOCUMENTS

| | | | |
|---|---|---|---|
| WO | 2013002782 | A1 | 1/2013 |
| WO | 2013009312 | A1 | 1/2013 |

*Primary Examiner* — Marrit Eyassu

(74) *Attorney, Agent, or Firm* — Shawn Hunter

(57) ABSTRACT

A data monitoring system includes a data monitoring tool incorporated into a work string proximate a bottom hole assembly. The data monitoring tool detects at least one wellbore condition and at least one force experienced by the data monitoring tool.

17 Claims, 5 Drawing Sheets

(56) References Cited

U.S. PATENT DOCUMENTS

| | | | | |
|---|---|---|---|---|
| 2011/0083845 | A1* | 4/2011 | McLaughlin | E21B 31/107 166/254.2 |
| 2011/0253447 | A1* | 10/2011 | Gleitman | E21B 17/003 175/48 |
| 2013/0120154 | A1 | 5/2013 | Gleitman | |
| 2013/0186690 | A1* | 7/2013 | Surjaatmadja | E21B 4/18 175/57 |
| 2015/0059463 | A1* | 3/2015 | Kenison | E21B 47/00 73/152.22 |
| 2016/0017675 | A1* | 1/2016 | Armstrong | E21B 19/24 166/53 |
| 2019/0128114 | A1* | 5/2019 | Bryant | E21B 45/00 |

* cited by examiner

REAL-TIME TENSION, COMPRESSION AND TORQUE DATA MONITORING SYSTEM

BACKGROUND OF THE INVENTION

1. Field of the Invention

The invention relates generally to devices and systems used to measure downhole conditions and forces during downhole operations.

2. Description of the Related Art

Modern downhole operations include milling, stimulation and well cleanouts. Typically, a work string is used to perform a downhole operation and can include a bottom hole assembly that is run into a wellbore on a tubing string. The tubing string is commonly made up of coiled tubing.

SUMMARY OF THE INVENTION

The invention provides a data monitoring system which includes a data monitoring tool which can be incorporated into a work string, often proximate the bottom hole assembly. An exemplary data monitoring tool is described in the form of a TCT (tension, compression, torque) data monitoring tool that has the capabilities of detecting the forces upon the bottom hole assembly during operation. In addition, the TCT data measurement tool can detect and monitor temperature and pressure at locations within the wellbore proximate the bottom hole assembly. Preferably, the TCT data monitoring tool has flow-through capability which allows fluids and/or objects to be transmitted through the data monitoring tool. Preferably also, Telecoil is used to transmit data acquired by the TCT data monitoring tool to surface.

According to described embodiments, the TCT data monitoring tool has a modular configuration which permits the tool to be customized for particular tasks. The data monitoring tool can be provided with a camera device which is capable of capturing visual images of the wellbore environs. The data monitoring tool might also be provided with a casing collar locator or other depth detector.

In accordance with particular methods of the invention, real-time pressure and temperature data is used for mechanical force and torque compensation where the TCT data monitoring tool is part of the bottom hole assembly. Optionally, the system zeros the force/torque reading before each measurement to avoid any noise in the electronic signals. A data monitoring tool in accordance with the present invention provides the capability in real time to improve operational efficiency and accelerate well recovery in all types of coiled tubing-based operations. The tool can provide accurate, real-time downhole monitoring of high resolution depth correlation, differential pressure and temperature as well as TCT data.

A TCT data monitoring tool is described which is capable of measuring at least one wellbore condition and at least one force experienced by the data monitoring tool. In described embodiments, the at least one wellbore condition is a wellbore condition from the group consisting of differential temperature, differential pressure, and location (depth) within the wellbore, and the at least one force is a force from the group consisting of axial tension force, axial compression force and torque force. Applied forces at surface are compared to measured forces experienced by the TCT data monitoring tool, which permits users to adjust the applied forces accordingly to compensate for downhole conditions.

In described embodiments, the data monitoring system also provides a zeroing function which permits previously measured values to be cleared prior to additional data monitoring being conducted. In preferred embodiments, the zeroing function is initiated by activating a control, such as a zeroing button, which will clear the measured data. This feature allows data monitoring to be more accurate by eliminating smaller errors which might be introduced over time from accumulating to create larger errors. Additionally, the zeroing function removes noise from the sensors. In described embodiments, the zeroing function is performed when either the work string encounters an obstruction within the wellbore or when flow rate through the work string is changed.

BRIEF DESCRIPTION OF THE DRAWINGS

For a thorough understanding of the present invention, reference is made to the following detailed description of the preferred embodiments, taken in conjunction with the accompanying drawings, wherein like reference numerals designate like or similar elements throughout the several figures of the drawings and wherein.

DETAILED DESCRIPTION OF THE PREFERRED EMBODIMENTS

Figure 1:
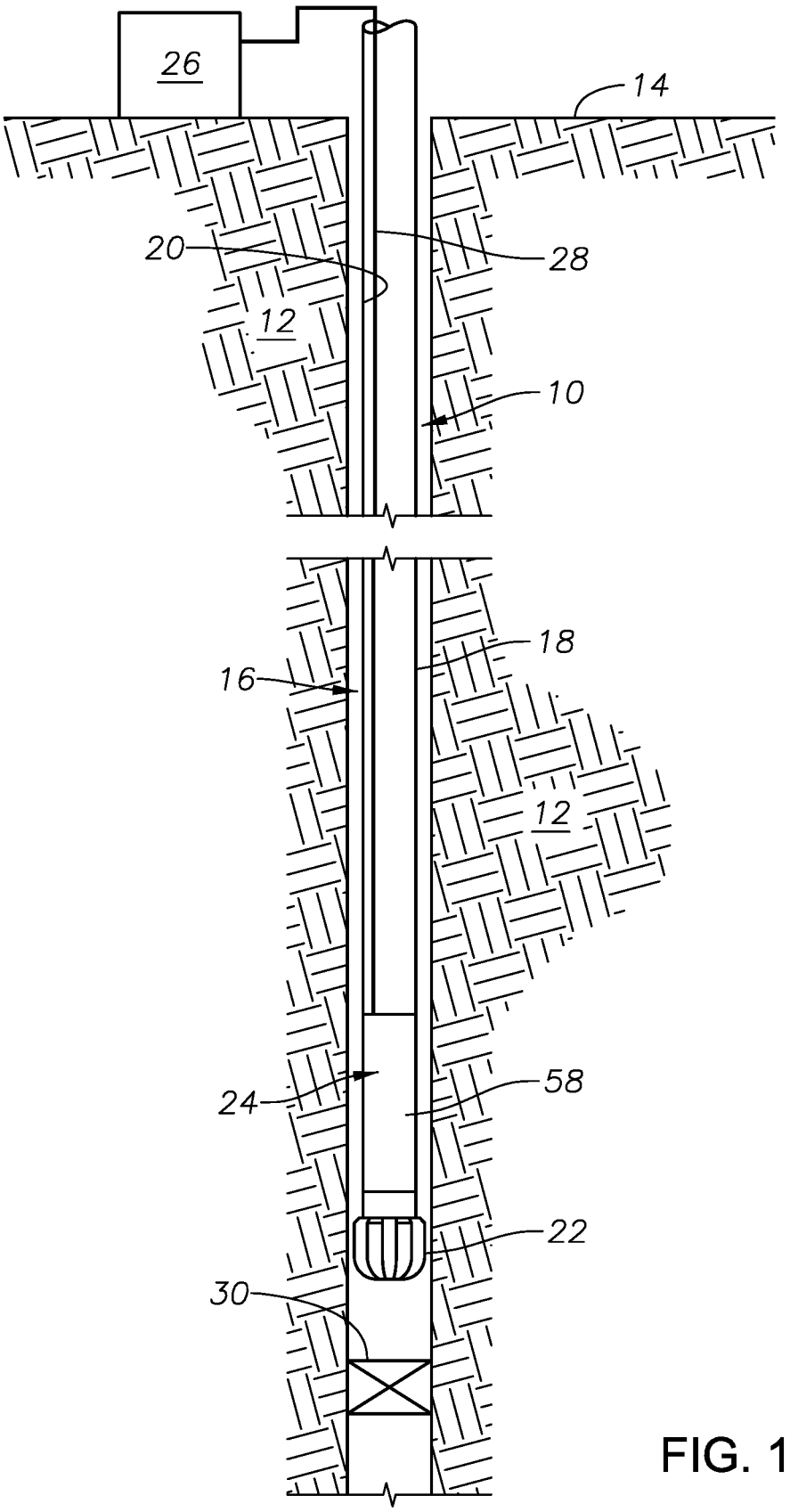
FIG. 1 is a side, cross-sectional view of a wellbore having a work string disposed therein which includes an exemplary TCT data monitoring tool in accordance with the present invention.

FIG. 1 illustrates an exemplary wellbore 10 that has been drilled through the earth 12 from the surface 14. It is noted that, while wellbore 10 is illustrated as a substantially vertical wellbore, it might, in practice, have portions that are inclined or horizontally-oriented. The wellbore 10 might have a metallic casing or, as depicted, lack such a casing.

A work string 16 is disposed within the wellbore 10. In the depicted embodiment, the work string 16 is a milling tool string, the object of which is to dispose a milling device to a location within the wellbore 10 wherein milling is to be performed. The work string 16 includes a running string 18 which is made up of coiled tubing. A flowbore 20 is defined along the length of the running string 18. A milling bottom hole assembly 22 is located at the distal end of the work string 16. The milling bottom hole assembly 22 features a rotary milling bit and milling motor which is driven by fluid flow from surface 14 through the flowbore 20 and the TCT data monitoring tool 24. The TCT data monitoring tool 24 is incorporated into the work string 16 in between the milling bottom hole assembly 22 and the running string 18. It will be understood by those of skill in the art that, during operation within the wellbore 10, drilling mud or other fluid is typically pumped down through the running string 18, TCT data monitoring tool 24 and milling bottom hole assembly 22. The milling bottom hole assembly 22 is intended to be brought into contact with and mill away obstruction 30.

A data processor 26 is preferably located at surface 14 to receive data from the TCT data monitoring tool 24. The data processor 26 can be a computer with suitable programming to perform calculations and computer modeling of the type described herein. Preferably, the data processor 26 receives data in real-time from TCT data monitoring tool 24. Received data is preferably stored by the data processor 26 and is displayed using a monitor or other human interface method. Preferably also, data received by the data processor 26 can be exported to other systems for processing. In certain embodiments, the data processor 26 is programmed to compensate for wellbore temperature and/or pressure effects on tension, compression and torque data in order to provide more accurate results.

A data communications conduit 28 is used to transmit data representative of the detected wellbore condition(s) and force(s) to the data processor 26. Preferably, the data communications conduit 28 is tubewire, such that Telecoil® is used to transmit data from the TCT data monitoring tool 24. Telecoil® is coiled tubing which incorporates tube-wire that can transmit power and data. Tubewire is available commercially from manufacturers such as Canada Tech Corporation of Calgary, Canada. Data communications conduit 28 is shown within the flowbore 20 of the running string 18.

Figure 2:
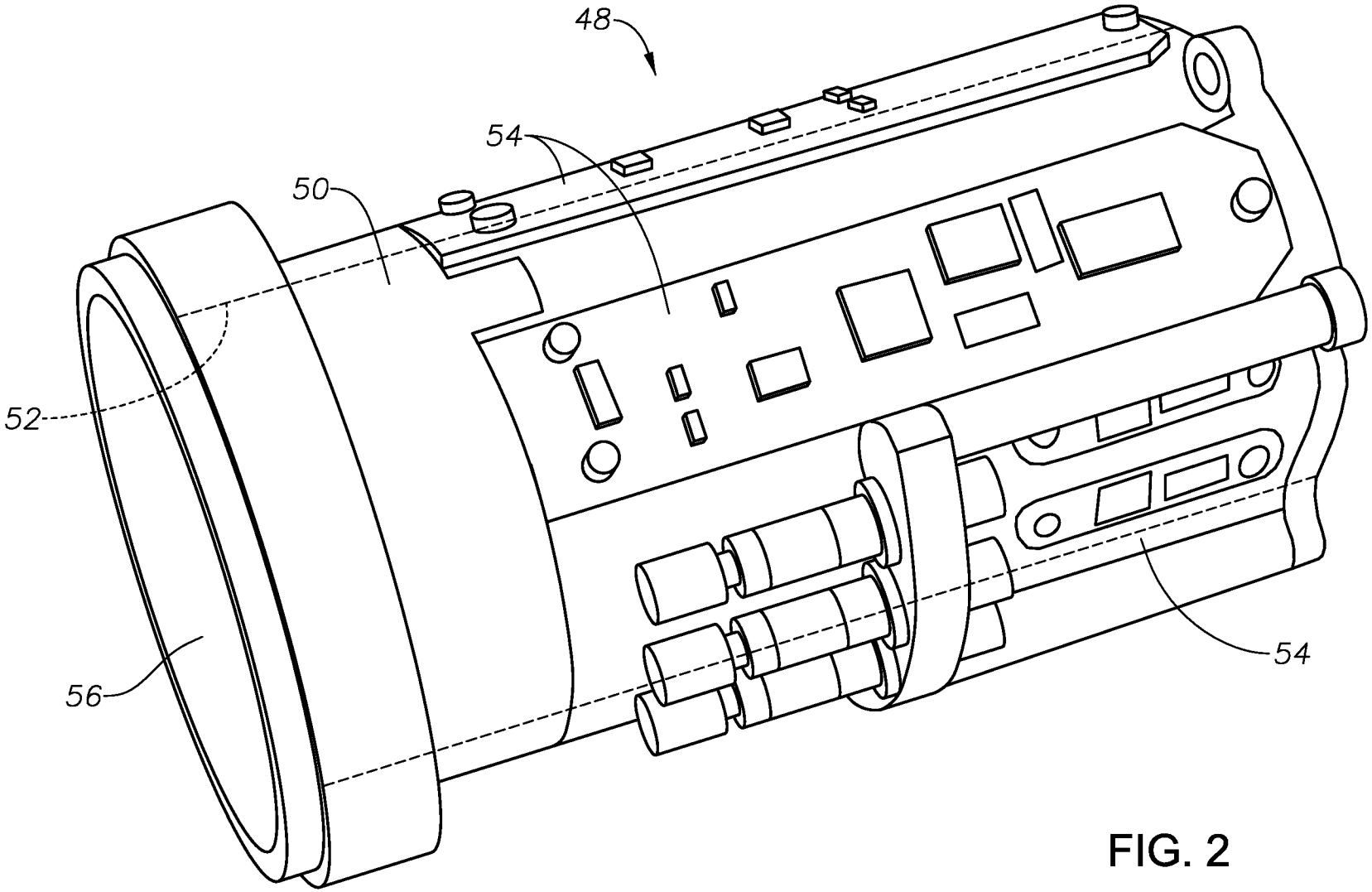
FIG. 2 is an isometric view of interior portions of an exemplary TCT data monitoring tool shown apart from other components.
Figure 3:
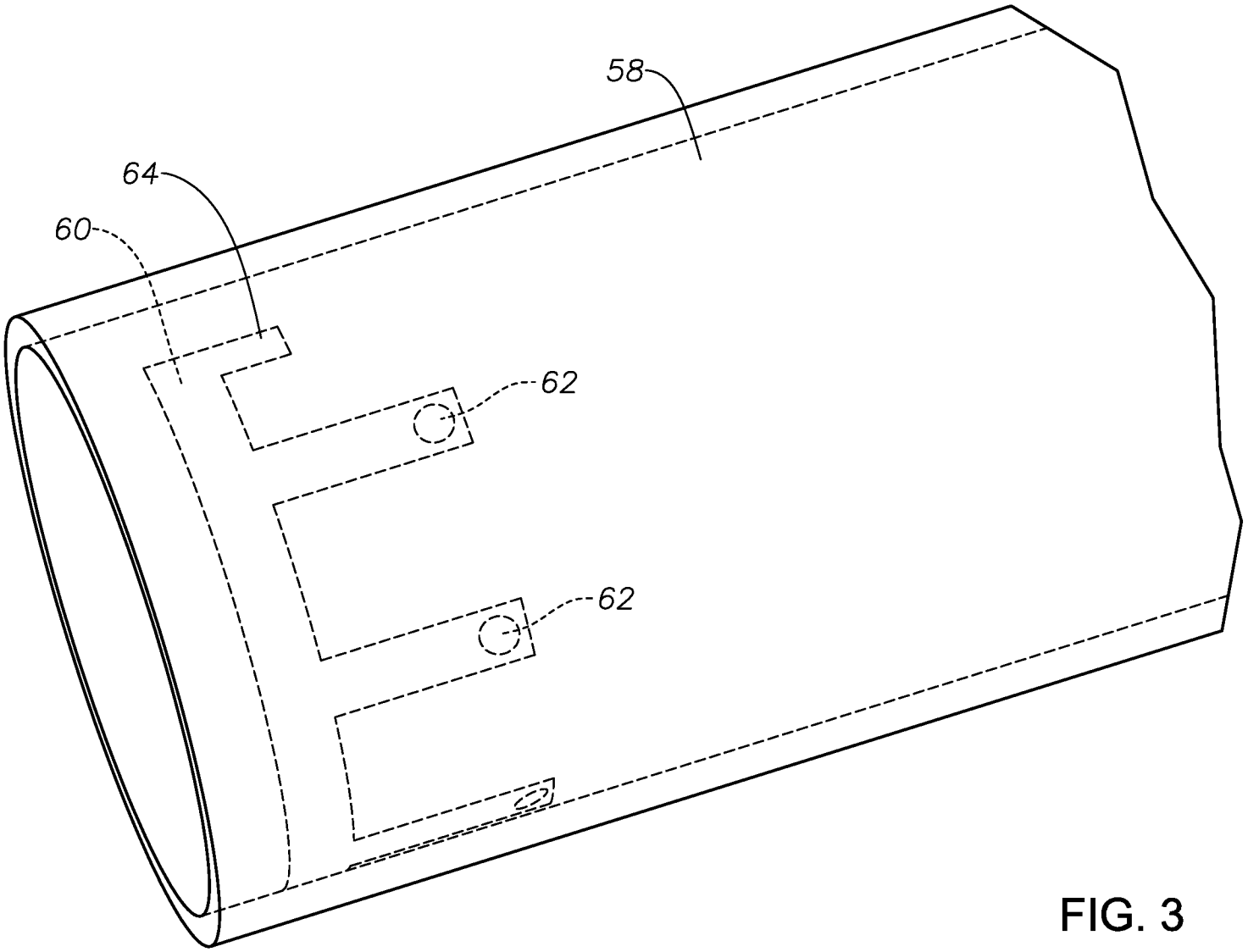
FIG. 3 is an exterior view of an exemplary housing for the TCT tool showing sensors affixed thereto.

In preferred embodiments, the TCT data monitoring tool 24 features sensors for measuring at least one wellbore condition, such as real-time differential temperature, differential pressure and/or location (i.e., depth) within the wellbore 10. In addition, the sensors will detect and measure at least one force experienced by the TCT data monitoring tool 24, such as axial force (tension and/or compression), and/or torque. It is further preferred that the TCT data monitoring tool 24 has a central flow-through path which allows fluids and/or objects to be transmitted through the data monitoring tool. This feature would allow, for example, the milling motor of the milling bottom hole assembly 22 to be powered by fluid flow from surface. FIGS. 2 and 3 depict portions of an exemplary TCT data monitoring tool 24 apart from other components of a bottom hole assembly. FIG. 2 depicts an interior module 48 for the TCT data monitoring tool 24 wherein a central frame 50 defines a central flow bore 52 along its length. Circuit boards 54 are mounted upon the central frame 50. The circuit boards 54 are typically printed circuit boards which contain programming for signal processing, signal conditioning and power gauge excitation. When the module 48 is made up with the running string 18 and milling bottom hole assembly 22, the central frame 50 provides a flow-through path 56 which will be aligned with the flowbore 20 of the running string 18. FIG. 3 illustrates an exemplary outer pressure housing 58 which would enclose the module 48, including the central frame 50 and circuit boards 54. Preferably, the outer housing 58 will provide fluid tightness and pressure isolation when assembled with the module 48 to protect the circuit boards 54. A foil strain gauge strip 60 is secured to the interior surface of the outer housing 58. The strain gauge strip 60 includes a number of sensors 62 which detect strain associated with pressure and/or temperature experienced by the outer housing 58 during operation within the wellbore 10. Electrical connection 64 extends from the strain gauge strip 60 to one or more of the circuit boards 54 of the module 48. The sensors 62 are preferably pressure or strain transducers which are rated for measurement of axial and torque forces on the order of 30,000 lbs. and 1,500 ft-lbs, respectively which are experienced by the outer pressure housing 58 of the tool 24.

Figure 4:
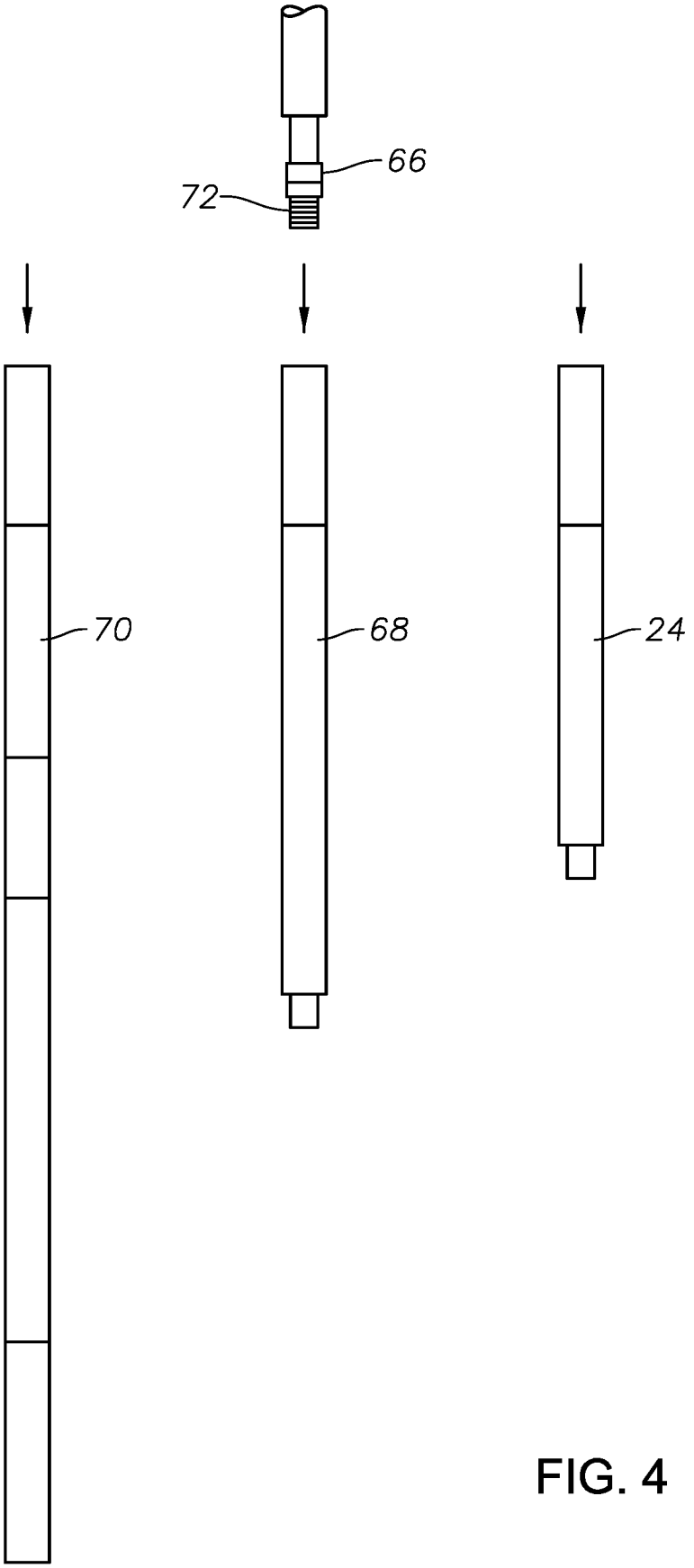
FIG. 4 is a schematic depiction illustrating modular interconnection of different sensor arrangements with the data transmission arrangement.

Preferably also, the TCT data monitoring tool 24 has a modular configuration which allows it to be removed from the work string 16 and replaced with another type of tool. With this modular configuration, a number of devices can be incorporated into the work string 16. FIG. 4 illustrates electrical connector 66, which forms the distal end of the tubewire 28, being able to interconnect with either a TCT data monitoring tool 24 or, alternatively, a logging adapter 68 or a camera adapter 70. These devices are examples of sensing tools which can be incorporated into the work string 16 above the milling bottom hole assembly 22. Each of the three subassemblies (24, 68, 70) can be used separately for certain purposes. For example, the camera adapter 70 could be used with an associated camera subassembly. Other such subassemblies, including the TCT data monitoring tool 24 can be used individually between the electrical connector 66 and other tools, such as a milling motor. The electrical connector 66 is preferably provided with pin-type threading 72 which will permit it to be readily secured to a complementary threaded connection on any of the devices 24, 68 or 70. A user can switch between the various devices by withdrawing the work string 16 from the wellbore 10, disconnecting the unwanted device and interconnecting the desired device with the electrical connector 66.

In operation, the work string 16 is run into the wellbore 10 so that the milling bottom hole assembly 22 is proximate an obstruction 30 within the wellbore 10. The milling bottom hole assembly 22 is then operated to mill away the obstruction 30. During operation, the TCT data monitoring tool 24 detects temperature and pressure within the wellbore 10 proximate the obstruction 30. The TCT data monitoring tool 24 also detects tension, compression and torque forces upon the milling bottom hole assembly 22 during milling.

During milling, data indicative of the sensed wellbore parameters and forces is transmitted to the data processor 26 at surface 14. An operator can utilize the data that is provided to surface 14 by the TCT data monitoring tool 24 to adjust the milling operation. For example, data modeling by the data processor 26 uses real-time pressure and temperature data to indicate to an operator what steps need to be taken to maximize milling rate or penetration. The following equation can be used:

$$F(p,T)=F(p_0,T_0)*K_F*p_{F,correction}*T_{F,correction}+C_F(p,T)$$

where:

F is the force (i.e., tension or compression)

p is downhole pressure

T is downhole temperature $P_0$ is the atmospheric pressure $T_0$ is the atmospheric temperature $K_F$ is a scaling empirical constant $P_{F,correction}$ is the downhole pressure correction $T_{F,correction}$ is the downhole temperature correction $C_F$ is a scaling empirical parameter In the most general sense, the downhole pressure and temperature corrections as well as the scaling parameter $C_F(p,T)$ can be derived analytically or provided from laboratory data and stored in tables. A similar relationship is used for torque:

$$M(p,T)=F(p_0,T_0)*K_M*P_{M,correction}*T_{M,correction}+C_M(p,T)$$

Pressure readings by the sensors 62 can be used to identify and compensate for downhole pressure and temperature conditions experienced proximate the bottom hole assembly 22. Pushing and pulling force errors on the running string 18 can be detected and compensated for as well. Applied forces are compared to measured forces experienced by the TCT data monitoring tool 24. When pumping fluid pressure and/or flow are changed at surface, the internal pressure and temperature can be changed to compensate. Tension or compression readings by the sensors 62 are adjusted by the data processor 26 to compensate for downhole pressure and temperature conditions experienced by the sensors 62. Torque readings provided by the TCT data monitoring tool 24 could be used to optimize weight-on-bit during milling to prolong mill and motor life.

Figure 5:
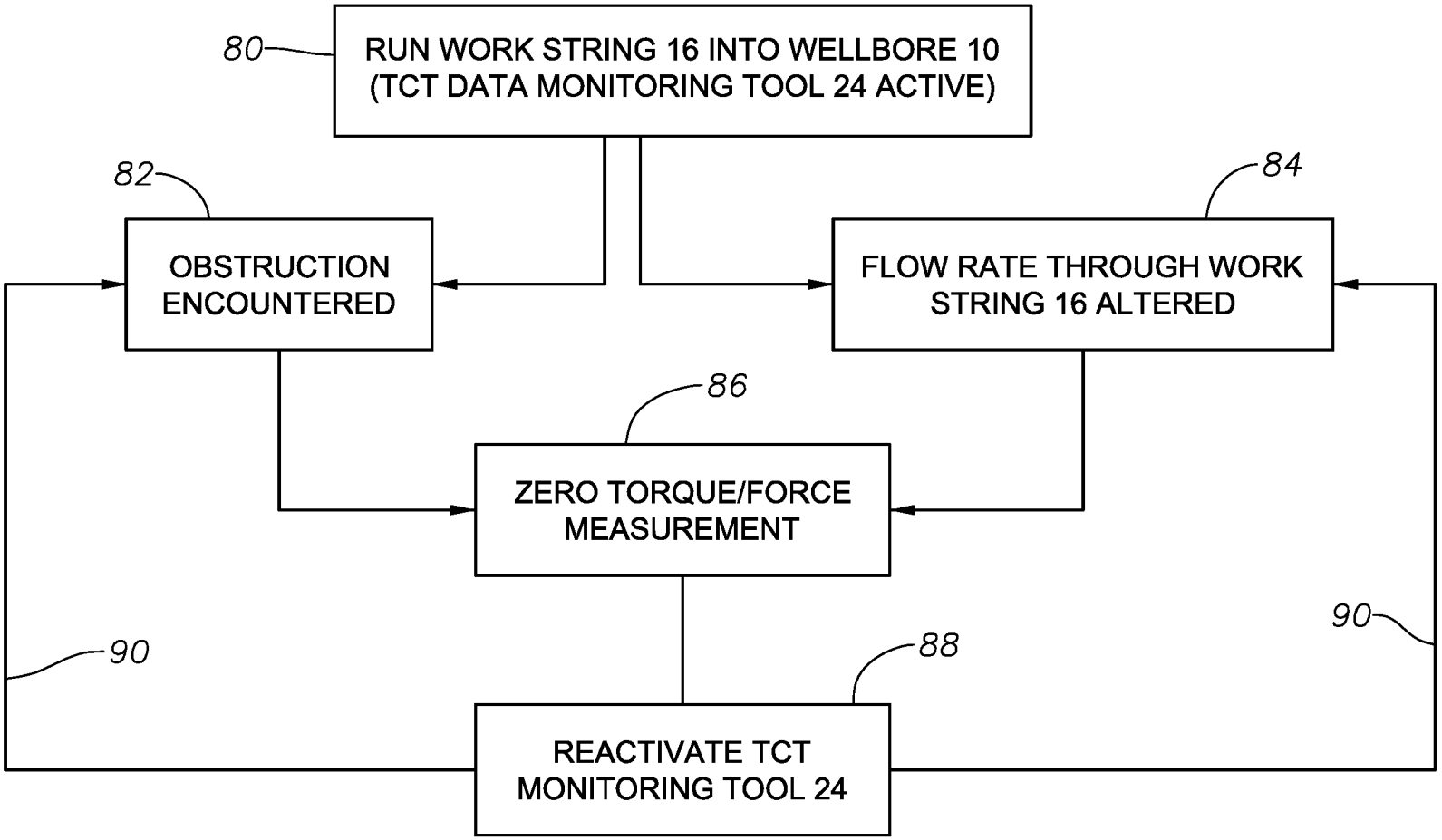
FIG. 5 is a schematic diagram illustrating an exemplary data monitoring process in which zeroing of previous values is being performed.

Preferably, the system zeros the force/torque reading before each measurement to avoid any noise in the electronic signals. The data processor 26 can be programmed to record and/or display real time downhole force/torque readings correlated with depth or position within the wellbore 10. When the TCT data monitoring tool 24 is run into the wellbore 10, even without encountering any obstacles, the force/torque readings received by the data processor 26 may be non-zero due to fluid flow through the running string 18, TCT data monitoring tool 24 and milling bottom hole assembly 22. Additionally, there is increased pressure and temperature experienced as the tool 24 is lowered into the wellbore 10. If the tool 24 encounters an object, such as obstruction 30, the force/torque measurements may be inaccurate since the pressure/temperature effects may not have been completely removed. Therefore, the data processor 26 is programmed to zero out the force/torque readings prior to run into the wellbore 10 as well as prior to each reading of force/torque by the sensors. FIG. 5 is a flow diagram which illustrates the steps of an exemplary zeroing operation. In step 80, the work string 16, including the TCT data monitoring tool 24, is run into the wellbore 10. During this time the TCT monitoring tool 24 is active so that torque and axial tension and compression forces are being measured by the TCT data monitoring tool 24. In step 82, an obstruction is encountered by the milling bottom hole assembly 22 in the wellbore 10. The obstruction might be debris within the wellbore 10 or it might be the obstruction 30 which is to be milled out. Contact between the milling bottom hole assembly 22 and an obstruction will alter force and torque measurements being obtained by the sensors 62. Contact with an obstruction within the wellbore 10 will normally be indicated to an operator at surface 14 by a reduction in tool weight, which will enable the operator to take subsequent action. Alternatively, in step 84, flow rate through the running string 18 is altered, either by increasing it or decreasing it. The change in flow rate will alter the internal pressure of the TCT monitoring tool 24 and thereby affect the readings obtained by the sensors 62 for force and torque. In step 86, the force/torque measurements previously detected by the sensors 62 are set to zero by clearing them from memory. The zeroing step will also reduce or eliminate noise from the sensors 62. As noted, this would normally be done by an operator affirmatively changing the readings, such as by pressing a zeroing, or reset, button associated with the data processor 26 to accomplish this. Alternatively, the data processor 26 may be programmed and configured to perform a zeroing function in response to either an encounter with an obstruction or a change in flow rate. In step 88, the TCT monitoring tool 24 is once again activated to measure at least one wellbore condition (pressure, temperature) and at least one force (torque, axial tension, axial compression) experienced by the TCT data monitoring tool 24. These steps may be partially iterative, as indicated by arrows 90 in FIG. 5.

A TCT data monitoring tool in accordance with the present invention provides the capability in real time to improve operational efficiency and accelerate well recovery in all types of coiled tubing-based operations. The tool can provide accurate, real-time downhole monitoring of high resolution depth correlation, differential pressure and temperature as well as TCT data.

A data monitoring system is described which includes a data monitoring tool 24 which can be incorporated into a work string 16 proximate a bottom hole assembly, such as milling bottom hole assembly 22. The data monitoring system also includes a data processor 26 which receives data from data monitoring tool 24. In described embodiments, sensors 62 within the data monitoring tool 24 are disposed to detect at least one wellbore condition and at least one force which are experienced by the outer housing 58 of the data monitoring tool 24.

Those of skill in the art will recognize that numerous modifications and changes may be made to the exemplary designs and embodiments described herein and that the invention is limited only by the claims that follow and any equivalents thereof.

What is claimed is:

1. A data monitoring system for use in monitoring wellbore conditions and downhole forces within a wellbore, the data monitoring system comprising:

an outer housing;

a plurality of sensors within the outer housing for monitoring at least one wellbore condition and at least one force experienced by the data monitoring system;

a flow-through path within the outer housing to permit fluid or objects to be passed axially through the outer housing;

a data processor which compares the at least one force sensed by the plurality of sensors to at least one actual force, the at least one actual force including torque, applied to the system within the wellbore to avow adjustment of the at least one actual applied force based upon programmed data, the programmed data including torque data, said programmed data further being calculated based upon compensating for effects of the at least one wellbore condition monitored by the plurality of sensors;

the data processor is programmed to model tension, compression and torque data in real time based upon data provided by the sensors; and the data processor is configured to permit force or torque data, sensed by the plurality of sensors, within the data processor to be zeroed out following an encounter with an obstruction sufficient to alter force and torque measurements being obtained by the sensors.

2. The data monitoring system of claim 1 further comprising:

a data communications conduit for transmitting data from the sensors to the data processor.

3. The data monitoring system of claim 2 wherein the data communications conduit comprises tubewire.

4. The data monitoring system of claim 1 wherein the data processor is configured to permit force or torque data within the data processor to be zeroed out following a change in flow rate within the flow-through path.

5. The data monitoring system of claim 1 wherein the at least one wellbore condition is from the group consisting of temperature and pressure.

6. The data monitoring system of claim 1 wherein the at least one force is from the group consisting of axial tension force, axial compression force, and torque.

7. The data monitoring system of claim 1 wherein the sensors are disposed upon the outer housing to monitor the at least one wellbore condition and at least one force which are experienced by the outer housing.

8. The data monitoring system of claim 1 wherein the data processor is configured to adjust tension or compression readings by the sensors to compensate for downhole pressure and temperature conditions experienced by the sensors.

9. A data monitoring system for use in monitoring wellbore conditions and downhole forces within a wellbore, the data monitoring system comprising:

a data monitoring tool incorporated into a work string proximate a bottom hole assembly in the wellbore, the data monitoring tool including an outer housing and a plurality of sensors in contact with the outer housing for monitoring at least one wellbore condition and at least one force, including tension, compression and torque, experienced by the outer housing of the data monitoring tool;

a data processor located at a surface location to receive data detected by the sensors;

wherein the data processor is configured to adjust tension, compression and torque readings by the sensors to compensate for downhole temperature conditions experienced by the sensors, the adjustment further using programmed correction data which is derived analytically or provided from laboratory data; and the data processor is configured to permit force or torque data, sensed by the plurality of sensors, within the data processor to be zeroed out following an encounter with an obstruction sufficient to alter force and torque measurements being obtained by the sensors.

10. The data monitoring system of claim 9 wherein the at least one wellbore condition is from the group consisting of temperature and pressure and the at least one force is from the group consisting of axial tension force, axial compression force, and torque.

11. The data monitoring system of claim 9 further comprising a data communications conduit for transmitting data from the sensors to the data processor.

12. The data monitoring system of claim 11 wherein the data communications conduit comprises tubewire.

13. The data monitoring system of claim 9 wherein the data processor is configured to permit force or torque data within the data processor to be zeroed out following a change in flow rate within the flow-through path.

14. The data monitoring system of claim 9 wherein the data processor is further configured to adjust tension or compression readings by the sensors to compensate for downhole pressure conditions experienced by the sensors.

15. A data monitoring system for use in monitoring wellbore conditions and downhole forces within a wellbore, the data monitoring system comprising:

a data monitoring tool incorporated into a work string proximate a bottom hole assembly in the wellbore, the data monitoring tool including an outer housing and a plurality of sensors in contact with the outer housing for monitoring at least one wellbore condition and at least one force experienced by the outer housing of the data monitoring tool;

a data processor located at a surface location to receive data detected by the sensors as well as being programmed with corrections for sensed data based upon data modeling; and wherein the data processor is configured to adjust tension or compression readings by the sensors to compensate for downhole pressure conditions experienced by the sensors, the adjustment being provided by the programmed corrections; and the data processor is further configured to permit force data, sensed by the plurality of sensors, within the data processor to be zeroed out following an encounter with an obstruction sufficient to alter force measurements being obtained by the sensors.

16. The data monitoring system of claim 15 wherein the at least one wellbore condition is from the group consisting of temperature and pressure and the at least one force is from the group consisting of axial tension force, axial compression force, and torque.

17. The data monitoring system of claim 15 further comprising a data communications conduit for transmitting data from the sensors to the data processor.

* * * * *